US007531049B2

(12) United States Patent
Coleman et al.

(10) Patent No.: US 7,531,049 B2
(45) Date of Patent: May 12, 2009

(54) COMPOSITION AND METHOD USING SAME TO REMOVE URETHANE PRODUCTS FROM A SUBSTRATE

(75) Inventors: Kenneth C. Coleman, Chandler, AZ (US); Dennis Weinhold, Phoenix, AZ (US)

(73) Assignees: Danny P. Tepolt, Young, AZ (US); Nancy M. Tepolt, Young, AZ (US)

( * ) Notice: Subject to any disclaimer, the term of this patent is extended or adjusted under 35 U.S.C. 154(b) by 622 days.

(21) Appl. No.: 11/351,732

(22) Filed: Feb. 10, 2006

(65) Prior Publication Data

US 2006/0186379 A1 Aug. 24, 2006

Related U.S. Application Data

(60) Provisional application No. 60/651,735, filed on Feb. 10, 2005, provisional application No. 60/683,495, filed on May 19, 2005.

(51) Int. Cl.
*C11D 7/50* (2006.01)

(52) U.S. Cl. ..... 134/38; 510/202; 510/212

(58) Field of Classification Search ..... 134/38; 510/202, 212

See application file for complete search history.

(56) References Cited

U.S. PATENT DOCUMENTS

| | | | | |
|---|---|---|---|---|
| 4,780,235 | A | 10/1988 | Jackson | |
| 5,006,279 | A | 4/1991 | Grobbel et al. | |
| 5,035,829 | A | 7/1991 | Suwala | |
| 5,049,300 | A | 9/1991 | Fusiak et al. | |
| 5,049,314 | A | 9/1991 | Short | |
| 5,188,675 | A | 2/1993 | Dormon-Brailsford | |
| 5,232,515 | A | 8/1993 | Sullivan | |
| 5,298,184 | A | 3/1994 | Jarema | |
| 5,310,496 | A | 5/1994 | Taylor | |
| 5,332,526 | A | 7/1994 | Stanley | |
| 5,334,331 | A * | 8/1994 | Fusiak | 510/174 |
| 5,360,580 | A | 11/1994 | Dotolo et al. | |
| 5,413,729 | A | 5/1995 | Gaul | |
| 5,468,415 | A * | 11/1995 | Jarema | 510/106 |
| 5,487,789 | A | 1/1996 | Sim | |
| 5,514,300 | A | 5/1996 | Vlasblom | |
| 5,556,833 | A * | 9/1996 | Howe | 510/189 |
| 5,565,136 | A | 10/1996 | Walsh | |
| 5,604,193 | A | 2/1997 | Vlasblom | |
| 5,641,361 | A | 6/1997 | Walsh et al. | |
| 5,932,530 | A | 8/1999 | Radu et al. | |
| 6,001,192 | A | 12/1999 | Lallier et al. | |
| 6,030,466 | A | 2/2000 | Myers, II | |
| 6,150,318 | A * | 11/2000 | Silvester et al. | 510/284 |
| 6,358,901 | B1 | 3/2002 | Joye et al. | |
| 6,391,837 | B1 * | 5/2002 | Coleman | 510/238 |
| 6,555,512 | B1 * | 4/2003 | Coggeshall et al. | 510/340 |
| 6,833,345 | B2 | 12/2004 | Machac, Jr. et al. | |

(Continued)

*Primary Examiner*—Gregory E Webb
(74) *Attorney, Agent, or Firm*—Schmeiser, Olsen & Watts, LLP

(57) ABSTRACT

A composition for removing urethane products from a wide variety of substrates without the need for scraping, scrubbing, sanding, sandblasting and the like is provided. The composition is formed by combining water, a polar organic solvent, a mixture of organic esters, a hydrocarbon, and a polyether. The composition may optionally be formed by combining the components recited above along with an anionic surfactant. The composition may optionally be formed by combining the components recited above along with a thickener.

2 Claims, 1 Drawing Sheet

U.S. PATENT DOCUMENTS

| | | | | |
|---|---|---|---|---|
| 6,960,266 | B1 | 11/2005 | Schaefer | |
| 2004/0186033 | A1 | 9/2004 | Waldrop et al. | |
| 2004/0248753 | A1 | 12/2004 | Karlsson et al. | |
| 2005/0096400 | A1 | 5/2005 | Villwock et al. | |
| 2006/0142172 | A1 * | 6/2006 | Cioletti et al. | 510/365 |

* cited by examiner

COMPOSITION AND METHOD USING SAME TO REMOVE URETHANE PRODUCTS FROM A SUBSTRATE

CROSS REFERENCE TO RELATED APPLICATIONS

This application claims priority to U.S. Provisional Patent Application to Kenneth C. Coleman and Dennis Weinhold entitled "COMPOSITION AND METHOD USING SAME TO REMOVE URETHANE PRODUCTS FROM A SUBSTRATE," Ser. No. 60/651,735, filed Feb. 10, 2005 and to U.S. Provisional Patent Application to Kenneth C. Coleman and Dennis Weinhold entitled "COMPOSITION AND METHOD USING SAME TO REMOVE URETHANE PRODUCTS FROM A SUBSTRATE," Ser. No. 60/683,495, filed May 19, 2005, the disclosures of which are hereby incorporated entirely herein by reference.

BACKGROUND OF THE INVENTION

This invention is described in preferred embodiments in the following description. The invention will be described as removing certain urethane products, such as those sold by DOW Chemical, USA, and/or urethane products formed using certain isocyanates sold by DOW Chemical USA. The following description of the composition in accordance with the present invention, and method using that composition to remove urethane products from a substrate is not meant, however, to limit the invention to the removal of urethane products sold by DOW Chemical USA, or to the removal of urethane products formed using isocyanates sold by DOW Chemical USA.

Embodiments of the present invention comprise a composition, and a method using that composition, to remove urethane products from a substrate. Such products include, without limitation, foams, coatings, adhesives, and the like. Additionally, such urethane products may include other functionalities/repeat units, such as without limitation, ureas, amides, imides, isocyanurates, and the like.

Such products may further comprise full density materials as well as foams. Such full-density products may comprise one or more linear polymers, one or more cross-linked polymers, and combinations thereof.

As those skilled in the art will appreciate, a foam material comprises struts and voids. In certain embodiments, such foam products comprise integral-skin foams comprising a first portion having a first density, wherein that first portion is partially or substantially completely covered by a second portion having a second density, wherein the second density is greater than the first density. Such foam products may comprise one or more linear polymers, one or more cross-linked polymers, and combinations thereof. Such foam products may comprise flexible foams, rigid foams, and combinations thereof. Such foams may further comprise open cell foams, closed cell foams, and combinations thereof.

In certain applications, the urethane product may be formed using a di-isocyanate, such as and without limitation, Toluene Diisocyante ("TDI"), Diphenylmethane Diisocyanate ("MDI"), Hexamethylene Diisocyanate ("HDI"), and the like. In certain embodiments, the urethane product may be formed using a derivative of a di-isocyanate, such as without limitation, a polycarbodiimide-modified diphenylmethane diisocyanate, such as for example and without limitation, Isonate 143L sold by Dow Chemical. In certain embodiments, the urethane product may be formed using a urethane prepolymer having isocyanate end groups, for example and without limitation ISONATE 181 sold by Dow Chemical. In certain embodiments, the urethane product may be formed using polymeric MDI material sometimes referred to as a Polymethylene Polyphenyl Isocyanate or PAPI.

The substrate may comprise a rigid material, such as without limitation wood, metal, glass, engineering plastic, and the like, a flexible material, such as without limitation, a fabric, cloth, a textile, and combinations thereof, and the like.

As those skilled in the art will appreciate, a wide variety of urethane materials are sold in commerce by a number of vendors. As those skilled in the art will further appreciate, many adhesive formulations comprise urethane materials. This being the case, after a urethane material may be disposed on a substrate, that urethane material may be difficult to remove from the substrate. This is particularly true where a urethane foam product may be formed substantially synchronously with the application of one or more liquid components comprising one or more isocyanates, as described herein, to that surface.

For example, for about 10 years Dow Chemical Company has sold, and currently sells, in commerce a urethane gap filler under the tradename GREAT STUFF. That urethane material may be used during residential, commercial, and industrial construction, as well as in post-construction projects by individual home owners. In response to the question "How do I get foam off the side of my house?," DOW's website provides:

> There is no solvent that will remove cured polyurethane foam. Remove as much as possible with a dull scraper or a hacksaw blade and then try scrubbing the remaining film with a non-abrasive cleaner. If that does not work, gradually move up to more aggressive means including sanding, sandblasting and repainting.

See, http://www.dow.com/greatstuff/pro/faq.htm#faq1.

A composition and method using that composition have been discovered to remove GREAT STUFF, as well as a wide variety of other urethane materials, from a wide variety of substrates without resorting to scraping, scrubbing, sanding, sandblasting, and the like.

DISCLOSURE OF THE INVENTION

The present invention relates to a composition for removing urethane products from a wide variety of substrates without the need for scraping, scrubbing, sanding, sandblasting and the like. As used herein, "urethane product," means a solid material formed using, among other things, an isocyanate having a functionality greater than 1. Such urethane products may include other functionalities/repeat units, such as without limitation, ureas, amides, imides, isocyanurates, and the like.

An aspect of the present invention includes a composition for removing a urethane product from a substrate comprising (a) from about 80 to about 90 percent by weight of a polar organic solvent having a dielectric constant greater than about 30; (b) from about 2 to about 3 percent by weight of at least one polyether comprising the molecular structure

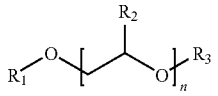

wherein R1 may be an alkyl group having between about 9 and about 20 carbons, R2 may be selected from the group consisting of hydrogen and methyl, and R3 may be selected from the group consisting of hydrogen and alkyl, and (n) may be between about 2 and about 10; (c) from about 4 to about 5 percent by weight of organic esters, wherein the esters are formed by heating soybean oil in the presence of methanol and a catalyst; and (d) about 5 percent by weight of water. Optionally, the composition may further comprise less than about 1 percent by weight of at least one hydrocarbon, wherein the at least one hydrocarbon comprises a cyclohexane or cyclohexene ring moiety.

Another aspect of the present invention includes a composition for removing a urethane product from a substrate comprising (a) from about 30 to about 90 percent by weight of a polar organic solvent having a dielectric constant greater than about 30; (b) less than about 60 percent by weight of at least one polyether or ether, the polyether comprising the molecular structure

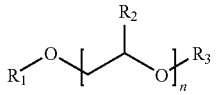

wherein R1 may be an alkyl group having between about 9 and about 20 carbons, R2 may be selected from the group consisting of hydrogen and methyl, and R3 may be selected from the group consisting of hydrogen and alkyl, and (n) may be between about 2 and about 10; (c) less than about 20 percent by weight of at least one keytone; and (d) less than about 50 percent by weight of water. Optionally, the composition may further comprise less than about 15 percent by weight of at least one hydrocarbon, wherein the at least one hydrocarbon comprises a cyclohexane or cyclohexene ring moiety.

Yet another aspect of the present invention includes a method of use of a composition for removing a urethane product from a substrate, the method comprising (a) providing a substrate having a urethane product disposed thereon; (b) disposing an effective amount of a composition onto the exposed portions of the urethane product; (c) reacting the composition with the product for a period of time sufficient for the product to swell, decompose, and solubilize; and (d) removing the solubilized product from the substrate.

The foregoing and other features and advantages of the present invention will be apparent from the following more detailed description of the particular embodiments of the invention, as illustrated in the accompanying drawing.

DETAILED DESCRIPTION OF EMBODIMENTS OF THE INVENTION

Figure 1:
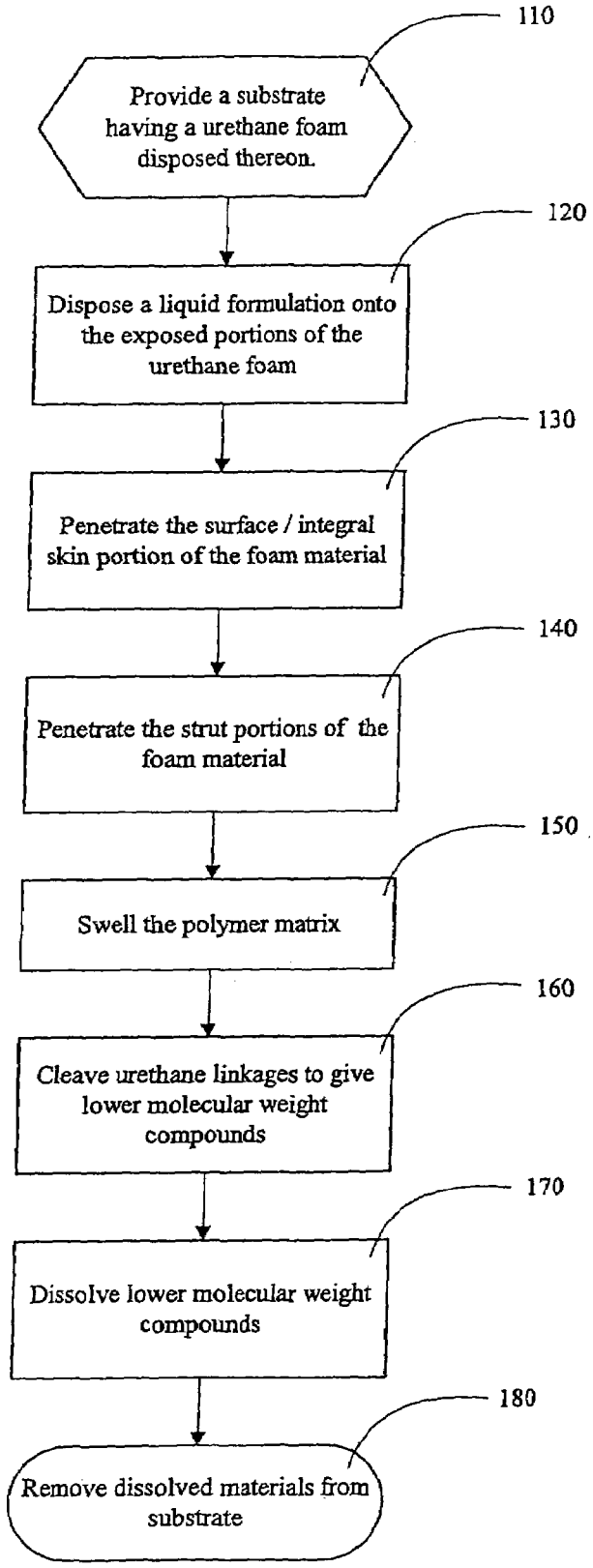
FIG. 1 may be a flow diagram of a method of use of a composition in accordance with the present invention.

The present invention relates to a composition for removing urethane products from a wide variety of substrates without the need for scraping, sanding, sandblasting and the like.

Particular embodiments of the present invention include a urethane removal composition. The composition may be formed by combining water, a polar organic solvent, a mixture of organic esters and a polyether. The composition may optionally be formed by combining the components recited above along with a hydrocarbon. The composition may optionally be formed by combining the components recited above along with an anionic surfactant. The composition may optionally be formed by combining the components recited above along with a thickener.

Table I recites the weight percentages for the components of the composition formulation.

TABLE I

| COMPONENT | WEIGHT PERCENT OF FORMULATION |
|---|---|
| POLAR ORGANIC SOLVENT | 80-90 |
| ORGANIC ESTERS | 4-5 |
| WATER | 5 |
| HYDROCARBON | 0-1 |
| POLYETHER | 2-3 |
| ANIONIC SURFACTANT | 0-3 |
| THICKENER | 0-5 |

As used herein, "polar organic solvent," means a carbon containing liquid having a dielelectric constant greater than 30. In certain embodiments, the polar solvent comprises N-Methylpyrrolidone.

As used herein, "organic esters," means the reaction product formed by heating soybean oil in the presence of methanol and a catalyst. The reaction causes the separation of soy oil into the organic esters and glycerine.

As used herein, "hydrocarbon" means one or more compounds comprising a cyclohexane or cyclohexene ring moiety, such as for example β-pinene (Compound I), menthene (Compound II), p-menthane (Compound III), and limonene (Compound IV).

I

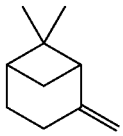

II

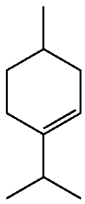

III

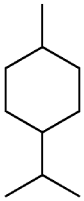

IV

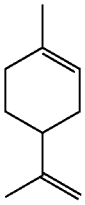

In certain embodiments, the hydrocarbon comprises α-pinene, citrene, carvene, and the like. In certain embodiments, the hydrocarbon comprises a product sold in commerce under the name ORANGE TERPENES by Florida Chemical Company, Inc., 351 Winter Haven Blvd., N.E., Winter Haven, Fla.

As used herein, polyether, means a compound having the structure

V

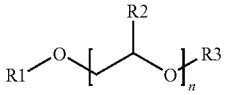

Wherein R1 may be an alkyl group having between about 9 and about 20 carbons, and wherein R2 may be selected from the group consisting of hydrogen and methyl, and wherein R3 may be selected from the group consisting of hydrogen and alkyl, and wherein (n) may be between about 2 and about 10. In certain embodiments, the polyether may be selected from the compounds recited in Table II.

TABLE II

| | |
|---|---|
| Condea Vista<br>Alfonic 1412-3 | Ethoxylated Linear Alcohol (40% E/O).. |
| Condea Vista<br>Alfonic 810-2 | Ethoxylated Linear Alcohol (40% E/O) |
| Condea Vista<br>BioSoft E-400 | Primary Alcohol Ethoxylate |
| Stepan<br>BioSoft TD-400 | Primary Alcohol Ethoxylate |
| Stepan<br>Delonic LF-EP-30 | Alkoxylated Linear Alcohol |
| DeForest<br>Genapol 26-L-3 | Natural Linear Alcohol Ethoxylate |
| Clariant<br>Genapol 26-L-3 | (C.sub.12-16) Natural Linear Alcohol Ethoxylate |
| Clariant<br>Iconol TDA-3 | TriDecyl Alcohol |
| BASF<br>Rhodasurf LA-3 | (C.sub.12-15) Straight Chain Fatty Alcohol Ethoxylate |
| Rhodia<br>Surfonic L24-3 | Linear Alcohol Ethoxylate |
| Huntsman<br>Surfonic TDA-3B | Linear Alcohol Ethoxylate |
| Huntsman<br>T-Det A-243 | Linear Alcohol Ethoxylate |
| Harcross<br>Ethal EH-2 | Ethoxylated Alcohol |
| Ethox<br>Surfonic LA-3 | Linear Alcohol Ethoxylate |
| Huntsman<br>Surfonic L12-2.6 | Linear Alcohol Ethoxylate |
| Huntsman<br>Tergitol 15-S-3 | C.sub.12-14 Secondary Alcohol Ethoxylate |
| Union Carbide<br>Neodol 91-2.5 | C.sub.9-11 Linear Primary Alcohol Ethoxylate |
| Shell<br>Tomadol 91-2.5 | Linear Primary Alcohol Ethoxylate |
| Tomah<br>Neodol 1-3 | C.sub.9-11 Linear Primary Alcohol Ethoxylate |
| Shell Canada<br>Tomadol 1-3 | C.sub.9-11 Linear Primary Alcohol Ethoxylate Tomah |
| Trycol 5966 | Ethoxylated Alcohol |
| Henkel | |

In certain embodiments, the polyether comprises a material having the CAS No. 68439-46-3. In certain embodiments, the polyether comprises a product sold in commerce under the name Q3 VIDET by VITECH International, Inc., 20 East Milwaukee Street, Suite 104, Janesville, Ohio.

In certain embodiments, the optional surfactant may be selected from the materials recited in Table III.

TABLE III

| Name | Company |
|---|---|
| Tween 21 | ICI Americas, Inc. |
| Tween 80 | ICI Americas, Inc. |
| Tween 81 | ICI Americas, Inc. |
| Tween 85 | ICI Americas, Inc. |
| Brij 76 | ICI Americas, Inc. |
| Brij 78 | ICI Americas, Inc. |
| Alkamuls EL-719 | Schibley Chemicals |
| Neodol 91-6 | Shell Canada |
| Igepal CO-530 | Rhone-Poulene, Inc. |
| Igepal CO-610 | Rhone-Poulene, Inc. |
| Igepal CO-630 | Rhone-Poulene, Inc. |
| Igepal CO-720 | Rhone-Poulene, Inc. |

In certain embodiments, the surfactant may be Mazclean TM EP.

In certain embodiments, the thickener comprises silica. In certain embodiments, that thickener comprises Cab-O-Sil fumed silica.

In other particular embodiments of the present invention, a urethane removal composition may be formed by combining water, a polar organic solvent, a keytone, and a polyether or ether. The composition may optionally be formed by combining the components recited above along with a hydrocarbon. The composition may optionally be formed by combining the components recited above along with an anionic surfactant. The composition may optionally be formed by combining the components recited above along with a thickener.

Table IV recites the weight percentages for the components of the composition formulation.

TABLE IV

| COMPONENT | WEIGHT PERCENT OF FORMULATION |
|---|---|
| POLAR ORGANIC SOLVENT | 30-90 |
| ETHER/POLYETHER | 0-60 |
| WATER | 0-50 |
| HYDROCARBON | 0-15 |
| KETONES | 0-20 |
| ANIONIC SURFACTANT | 0-3 |
| THICKENER | 0-5 |

As used herein, "polar organic solvent," generally means a carbon containing liquid having a dielelectric constant greater than 30. In certain embodiments, the polar solvent comprises one or more N-substituted pyrrolidones, i.e. Compound X, wherein R5 may be selected from the group consisting of methyl, ethyl, hydroxyethyl, propyl, phenyl, benzyl, cyclohexyl, and octyl.

X

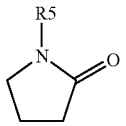

In certain embodiments, the ketone component may be selected from the group consisting of acetone, methyl ethyl ketone, methyl n-amyl ketone, methyl isobutyl ketone, and mixtures thereof.

As used herein, "hydrocarbon" means one or more compounds comprising a cyclohexane or cyclohexene ring moiety, such as for example β-pinene (Compound I), menthene (Compound II), p-menthane (Compound III), and limonene (Compound IV).

I

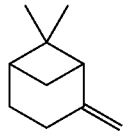

II

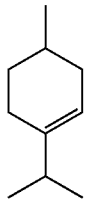

III

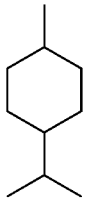

IV

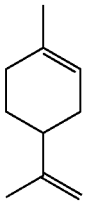

In certain embodiments, the hydrocarbon comprises α-pinene, citrene, carvene, and the like. In certain embodiments, the hydrocarbon comprises a product sold in commerce under the name ORANGE TERPENES by Florida Chemical Company, Inc., 351 Winter Haven Blvd., N.E., Winter Haven, Fla.

As used herein, polyether, means a compound having the structure

V

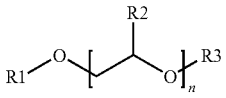

Wherein R1 may be an alkyl group having between about 9 and about 20 carbons, and wherein R2 may be selected from the group consisting of hydrogen and methyl, and wherein R3 may be selected from the group consisting of hydrogen and alkyl, and wherein (n) may be between about 2 and about 10.

In certain embodiments, the ether component may be selected from the group consisting of propylene glycol t-butyl ether, ethylene glycol monobutyl ether, dipropylene glycol monomethyl ether, propylene glycol (mono) butyl ether, propylene glycol n-propyl ether, (2-(2-methoxy methyl ethoxy) methylethoxy)propanol, propylene glycolmonomethyl ether propionate, 1-methoxy-2-propanol propionate, and mixtures thereof.

In certain embodiments, the polyether comprises a material having the CAS No. 68439-46-3. In certain embodiments, the polyether comprises a product sold in commerce under the name Q3 VIDET by VITECH International, Inc., 20 East Milwaukee Street, Suite 104, Janesville, Ohio.

In certain embodiments, the surfactant may be Mazclean TM EP.

In certain embodiments, the thickener comprises silica. In other certain embodiments, that thickener comprises Cab-O-Sil fumed silica.

Referring to the drawings, FIG. 1 summarizes a method to remove a cured urethane foam from a substrate using a composition in accordance with the embodiments of present invention. Referring now to FIG. 1, in step 110 a substrate, as described herein, may be provided wherein a urethane foam material, as described herein, is disposed on the surface of that substrate.

As those skilled in the art will appreciate, a urethane material may be formed by the reaction of a polyisocyanate, such as diisocyanate VI, with a polyol, such as diol VII, to form urethane VIII. As those skilled in the art will further appreciate, one or more chain extenders such as for example ethylene glycol, diethylene glycol, and the like, may also be reacted with polyisocyanate VI. Diol VII comprises a polyether material formed from the polymerization of ethylene oxide (R2 is H), propylene oxide (R2 is methyl), or a combination of both.

For the sake of illustration, a diisocyanate and a diol are illustrated. Those skilled in the art will appreciate, that one or more isocyanates having a functionality of greater than 2.0 and/or one or more polyols having a functionality of greater than 2.0 may similarly be used to give a cross-linked urethane product.

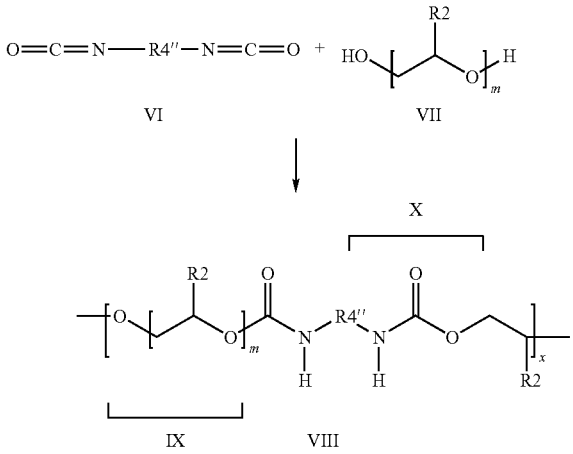

Urethane VIII comprises domains which are sometimes referred to as hard segments and soft segments. Portion IX of urethane VIII, i.e. the long-chain polyether portion, comprises a soft segment. Portion X, i.e. the urethane linkage portion, including any chain extender urethane linkages, comprises the hard segment. Polyisocyanate VI typically has an equivalent weight between about 125 and 200. Polyol VII may have an equivalent weight of between about 1000 to about 3000. This being the case, urethane VIII may comprise, on a weight basis, up to about 90 percent soft segment, i.e. polyether portion IX.

Referring once again to FIG. 1, in step 120 the method applies the composition described herein onto the urethane foam. In step 130, the polar organic solvent penetrates the foam skin, and initially cleaves the urethane polymer chain. The chemical structure of the polar organic solvent N-Methylpyrrolidone, as used in particular embodiments of the present invention, and the chemical structure of the substituted pyrrolidone, in other particular embodiments of the present invention, are similar to the chemical structure of the urethane linkage.

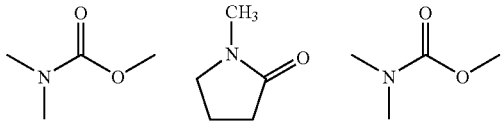

Urethane Linkage N-Methylpyrrolidone Urethane Linkage

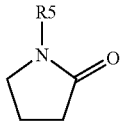

N-Substituted pyrrolidone

The polar organic solvent has been found to effectively disrupt the skin of the foam, thereby allowing the composition to penetrate into the foam core itself and in step 140 to contact and penetrate the struts comprising the foam.

The chemical structure of the polyether component is similar to the chemical structure of the polyether soft segment of the polyurethane. The polyether component facilitates contact of the composition with individual urethane polymer chains.

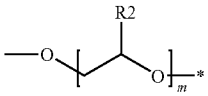

Polyol Repeat Unit

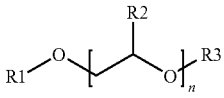

Polyether Component

After the composition has disrupted the foam skin, and the composition has penetrated the foam core, in step 150 the polyether, ester and hydrocarbon cause the polymer matrix to swell, affording even greater contact between the polar solvent and the polymer chains, and causing in step 160 polymer chain cleavage.

In step 170, the surfactant facilitates solubilization/emulsification of the lower molecular weight cleavage products in the polar solvent/water mixture. That surfactant further promoting rinsing of the dissolved/emulsified lower molecular weight materials from the substrate. The thickener holds the composition in place on non horizontal surfaces of both urethane and/or substrate extending exposure time which both accelerates solvation and provides economical use of product.

While the preferred embodiments of the present invention have been illustrated in detail, it should be apparent that modifications and adaptations to those embodiments may occur to one skilled in the art without departing from the scope of the present invention as set forth in the following claims.

The invention claimed is:

1. A method of use of a composition for removing a urethane product from a substrate, the method comprising:

(a) providing a substrate having a urethane product disposed thereon;

(b) disposing an effective amount of a composition comprising:

i) a polar organic solvent having a dielectric constant greater than about 30;

ii) a least one polyether comprising the molecular structure

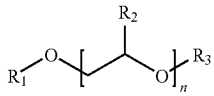

wherein

R1 is an alkyl group having between about 9 and about 20 carbons, R2 is selected from the group consisting of hydrogen and methyl, and R3 is selected from the group consisting of hydrogen and alkyl, and (n) is between about 2 and about 10;

iii) organic esters, wherein the esters are formed by hearing soybean oil in the presence of methanol and a catalyst;

iv) silica; and v) water;

(c) reacting the composition with the product for a period of time sufficient for the product to swell, decompose, and solubilize; and (d) removing the solubilized product from the substrate.

2. The method of claim 1, wherein the reacting of the composition with the product for a period of time sufficient for the product to swell, decompose, and solubilize further comprises:

(a) reacting the composition with the product for a period of time sufficient for the composition to penetrate the surface of the product;

(b) reacting the composition with the product for a period of time sufficient for the composition to cleave the product into lower molecular weight compounds;

(c) reacting the composition with the product for a period of time sufficient for the composition to solubilize the lower molecular weight compounds; and (d) removing the lower molecular weight material from the substrate.

* * * * *